US005593308A

United States Patent [19]

Kobayashi

[11] Patent Number: 5,593,308

[45] Date of Patent: Jan. 14, 1997

[54] CONNECTING ASSEMBLY FOR IGNITION PLUG IN GASOLINE ENGINE AND METHOD FOR PRODUCING SAME

[75] Inventor: Yoshinao Kobayashi, Yokkaichi, Japan

[73] Assignee: Sumitomo Wiring Systems, Ltd., Japan

[21] Appl. No.: 538,787

[22] Filed: Sep. 3, 1995

Related U.S. Application Data

[63] Continuation of Ser. No. 120,272, Sep. 10, 1993, abandoned.

[30] Foreign Application Priority Data

Sep. 25, 1992 [JP] Japan ..... 4-280851

[51] Int. Cl.[6] ..... H01R 13/44

[52] U.S. Cl. ..... 439/125; 313/135

[58] Field of Search ..... 313/135, 144; 439/125, 126, 127, 128; H01R 13/44

[56] References Cited

U.S. PATENT DOCUMENTS

| | | | |
|---|---|---|---|
| 4,758,189 | 7/1988 | Draxler | 439/848 |
| 5,083,932 | 1/1992 | Wyatt | 439/126 |
| 5,145,433 | 9/1992 | Yagi | 445/7 |
| 5,166,574 | 11/1992 | Yagi | 313/124 |
| 5,179,327 | 1/1993 | Yagi | 315/77 |
| 5,297,971 | 3/1994 | Nitta | 439/125 |

FOREIGN PATENT DOCUMENTS

| | | | |
|---|---|---|---|
| 362777 | 4/1990 | European Pat. Off. | H01T 13/04 |
| 0488216 | 5/1994 | European Pat. Off. | F02P 9/00 |
| 168985 | of 1980 | Japan | C23F 1/00 |

*Primary Examiner*—Wendy Garber
*Assistant Examiner*—Andrew B. Christensen
*Attorney, Agent, or Firm*—Bierman and Muserlian

[57] ABSTRACT

The invention aims to prevent a head of an ignition plug from being worn. A connecting assembly for an ignition plug P in a gasoline engine comprises a high tension supply terminal 11 adapted to be connected to a high tension cable C, a cylindrical ignition plug connecting terminal 12 having an outwardly extending projection 12*b*, a high tension supply terminal socket 13 secured to an end of the cylindrical ignition plug connecting terminal 12 and electrically contacted with the high tension supply terminal 11, and a cylindrical plug cap 14 made of a synthetic resin material for receiving the cylindrical ignition plug connecting terminal 12 therein with the outwardly extending projection 12*b* being embedded in an inner wall of the cap 14. The ignition plug connecting terminal 12 can be secured to the ignition plug P by embedding the outwardly extending projection 12*b* of the terminal 12 in the plug cap 14.

2 Claims, 8 Drawing Sheets

CONNECTING ASSEMBLY FOR IGNITION PLUG IN GASOLINE ENGINE AND METHOD FOR PRODUCING SAME

This application is a continuation, of application Ser. No. 08/120,272, filed Sep. 10, 1993, now abandoned.

BACKGROUND OF THE INVENTION

1. Field of the Invention

This invention relates to a connecting assembly for an ignition plug in a double overhead cam shaft type gasoline engine, in which a high tension cable is connected to the ignition plug and to a method for producing the same.

2. Statement of the Prior Art

In an overhead valve (OHV) type gasoline engine as well as a double overhead cam shaft (DOHC) type gasoline engine, an ignition plug is disposed at a deep position in the engine. Such a kind of gasoline engine is provided with a connecting assembly for the ignition plug such as the one disclosed in, for example, Japanese Utility Model Public Disclosure No. 55-188985 (1980), in order to connect a high tension cable to the ignition plug.

For convenience of explanation, the above known connecting assembly for the ignition plug will be described below by referring to FIG. 13.

FIG. 13 is a longitudinal sectional view of the connecting assembly 100 for the ignition plug P.

The connecting assembly 100 for the ignition plug P includes an ignition plug connecting terminal 101 and a plug cap 102.

The ignition plug connecting terminal 101 is attached to an end of a high tension cable C by pressing work and has a shape adapted to be mechanically mated with and electrically contacted with a terminal part Pa of the ignition plug P. Also, the ignition plug connecting terminal 101 is provided with an outwardly extending annular projection 101*a* on the outer periphery thereof.

The plug cap 102 is made of a synthetic insulating resin material and is inserted into a plug bore 103*a* formed in an engine cover 103. The plug cap is also provided on the interior with a shoulder 102*a* which engages with the annular projection 101*a* of the ignition plug connecting terminal 101.

The high tension cable C is inserted into the plug cap 102 through a proximal end of the cap. After a top end of the high tension cable C passed through a top end of the plug cap 102 has been pressed and connected to the ignition plug connecting terminal 101, the top end of the high tension cable C is retracted in the plug cap 102 until the annular projection 101*a* of the ignition plug connecting terminal engages with the shoulder 102*a*.

On the other hand, the terminal part Pa of the ignition plug P can be inserted into the plug cap 102 through a distal end of the cap. The terminal part Pa of the ignition plug P inserted in the plug cap 102 is electrically connected to the ignition plug connecting terminal 101 supported in the plug cap 102.

The plug cap 102 fixes the high tension cable C in the cap at the position where the ignition plug connecting terminal 101 contacts with the ignition plug P. The plug cap 102 is secured to the engine cover 103 through a waterresistant cap 104.

In the above conventional connecting assembly 100 for the ignition plug P, the ignition plug connecting terminal 101 is held in the plug cap 102 or the ignition plug P by engaging the annular projection 101*a* with the shoulder 102*a* in the plug cap 102.

However, since the ignition plug connecting terminal 101 is fixed incompletely in the plug cap 102 in the conventional connecting assembly 100, the ignition plug connecting terminal 101 and the ignition plug are vibrated at different frequencies on account of various vibrations caused during driving. Consequently, a head of the ignition plug P is subjected to a great wear.

SUMMARY OF THE INVENTION

A first object of the present invention is to provide a connecting assembly for an ignition plug in a gasoline engine, in which wear of a head of the ignition plug can be reduced.

A second object of the present invention is to provide a method for producing the connecting assembly for the ignition plug.

In order to achieve the first object, a connecting assembly for an ignition plug in a gasoline engine, in which a high tension cable is directly or indirectly connected to the ignition plug, in accordance with the present invention, comprises:

a high tension supply terminal adapted to be directly or indirectly connected to said high tension cable;

a cylindrical ignition plug connecting terminal having an outwardly extending projection;

a high tension supply terminal socket secured to an end of said cylindrical ignition plug connecting terminal and electrically contacted with said high tension supply terminal; and a cylindrical plug cap made of a synthetic resin material for receiving said cylindrical ignition plug connecting terminal therein with said outwardly extending projection being embedded in an inner wall of said cap.

In order to achieve the second object, a method for producing a connecting assembly for an ignition plug in a gasoline engine, in which a high tension cable is directly or indirectly connected to the ignition plug, in accordance with the present invention, comprises the steps of:

forming an ignition plug connecting cylindrical terminal having an outwardly extending projection by drawing;

securing a high tension supply terminal socket to said cylindrical ignition plug connecting terminal;

forming a cylindrical plug cap for receiving said cylindrical ignition plug connecting terminal therein with said outwardly extending projection being embedded in an inner wall of said cap; and coupling to said high tension supply terminal socket, a high tension supply terminal directly or indirectly attaching it to an end of said high tension cable by inserting said cable into said plug cap.

In the connecting assembly for the ignition plug in the gasoline engine in accordance with the present invention, the ignition plug connecting terminal is joined to the plug cap and movement of the ignition plug connecting terminal is limited with respect to the ignition plug. The ignition plug and the high tension cable are interconnected through the high tension supply terminal socket and the high tension supply terminal.

In the method for producing the connecting assembly for the ignition plug in the gasoline engine in accordance with the present invention, the cylindrical ignition plug having the outwardly extending projection and no clearance at the outer periphery thereof is formed by drawing. Accordingly, when the plug cap is formed by the synthetic resin material with the projection of the ignition plug terminal being embedded in the inner wall of the plug cap, the resin material does not flow into the ignition plug terminal. By connecting the high tension supply terminal to the high tension supply terminal socket, the high tension cable is directly or indirectly connected to the ignition plug.

DETAILED DESCRIPTION OF THE PREFERRED EMBODIMENTS

Referring now to FIGS. 1 through 12, embodiments of a connecting assembly for an ignition plug in a gasoline engine and a method for producing the same in accordance with the present invention will be described below.

Figure 1:
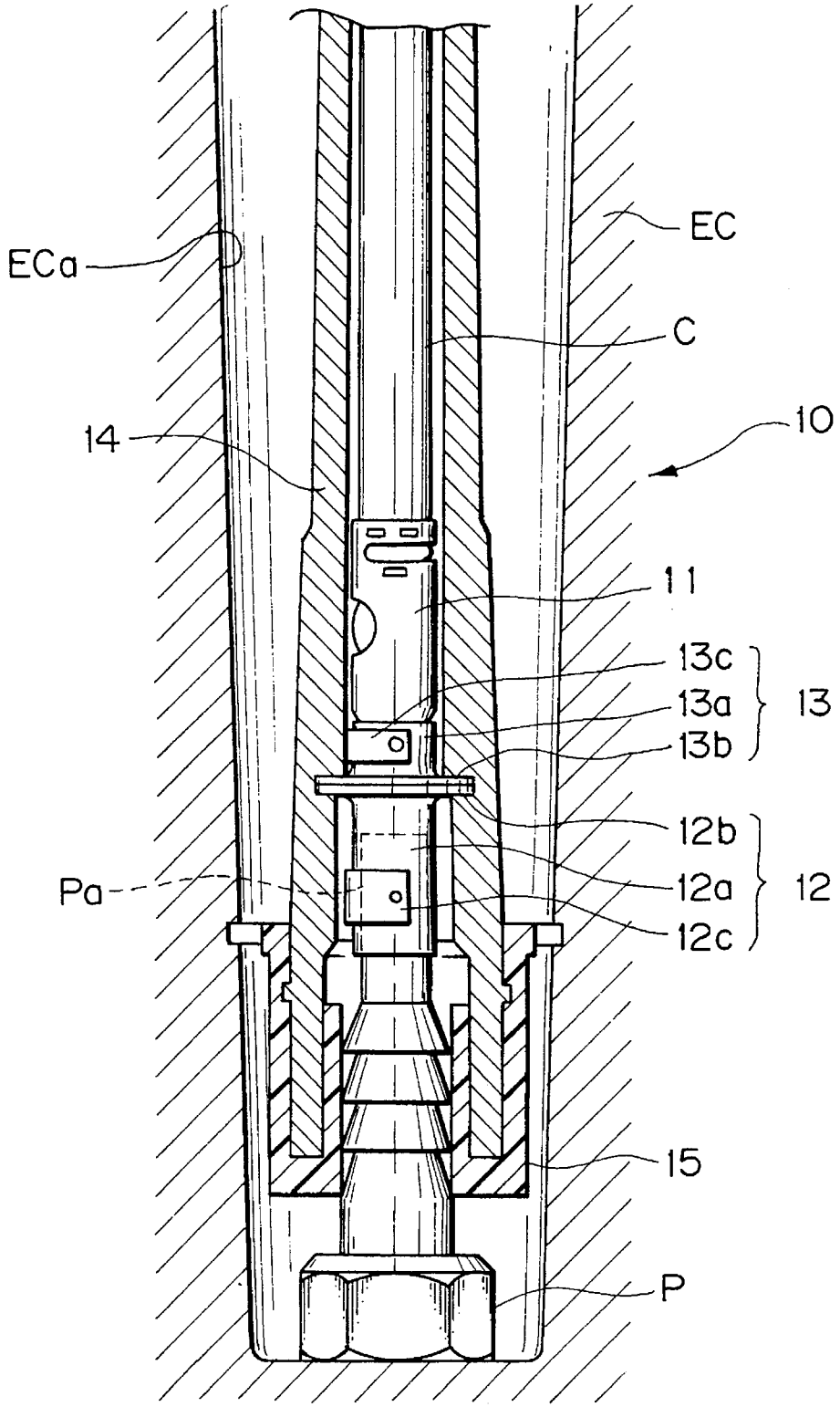
FIG. 1 is a longitudinal sectional view of an embodiment of a connecting assembly for an ignition plug in a gasoline engine in accordance with the present invention.

FIG. 1 shows a construction of a connecting assembly 10 for an ignition plug in a gasoline engine in accordance with the present invention. The connecting assembly 10 shown in FIG. 1 includes a high tension supply terminal 11, an ignition plug connecting terminal 12, a high tension supply terminal socket 13, and a plug cap 14. The assembly 10 serves to connect a high tension cable C to an ignition plug P secured to an engine cover (not shown).

The high tension supply terminal 11 is a press fit type terminal and is attached to an end of the high tension cable C beforehand. The high tension supply terminal 11 electrically contacts with the high tension supply terminal socket 13 by being inserted into a socket body 13*a* of the high tension supply terminal socket 13.

The ignition plug connecting terminal 12 is provided with a cylindrical terminal body 12*a* having no slit on the outer periphery thereof, a flange-like projection 12*b* integrally formed on an end of the terminal body 12*a*, and a C-shaped ring 12*c* and fitted on the termlnal body 12*a* without any elastic deformation.

Figure 3:
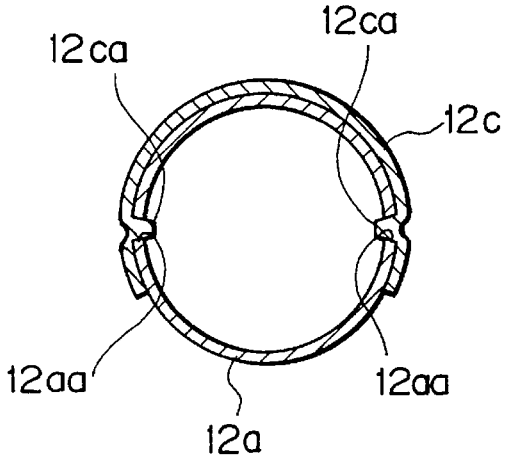
FIG. 3 is a cross sectional view of an ignition plug connecting terminal.

The termlnal part Pa of the ignition plug P is inserted into the terminal body 12*a* of the ignition plug connecting terminal 12. The ring 12*c* is provided on the interior with a projection 12*ca* which is embedded in the inner wall on the terminal body 12*a* through a through hole 12*aa* formed in the terminal body 12*a*, as shown in FIG. 3. When the terminal part Pa of the ignition plug P is inserted into the terminal body 12*a*, the terminal part Pa pushes the projection 12*ca* so that the ring 12*c* is widened against its elastic resistance. That is, the ignition plug connecting terminal 12 fixes the terminal part Pa of the ignition plug P inserted in the terminal body by means of the projection 12*ca* of the ring 12*c* without any elastic deformation.

The high tension supply terminal socket 13 includes a cylindrical socket body 13*a*, a flange-like projection 13*b* and a ring 13*c*. The projection 13*b* is spot-welded on the projection 12*b* of the ignition plug connecting terminal 12, so that the high tension supply terminal socket 13 is fixed coaxially on the ignition plug connection terminal 12.

The socket body 13*a* and projection 13*b* are formed integrally in the same manner as the terminal body 12*a* and projection 12*b* of the ignition plug terminal 12. Also, the ring 13*c* has the same shape as that of the ring 12*c*, is mounted on the socket body 13*a*, and is provided on the interior with a projection (not shown) which enters into the socket body 13*a* through a hole 13*aa* (FIG. 7) formed in the socket body 13*a*.

As described above, the high tension supply terminal 11 is inserted into the socket body 13*a*. The high tension supply terminal 11 inserted into the socket body 13*a* pushes the projection formed on the interior of the ring 13*c* so that the terminal 11 widens the ring 13*c* against the elastic resistance of the ring. Then, the high tension supply terminal 11 is fixed on the high tension terminal socket 13 without any elastic deformation.

The plug cap 14 is made of a synthetic resin material having heat resisting and insulating properties and formed into a cylindrical shape. As shown in FIG. 1, the ignition plug connecting terminal 12 and high tension supply terminal socket 13 are disposed within the plug cap while the projection 12*b* of the ignition plug connecting terminal 12 and projection 13*b* of the high tension supply terminal socket 13 are inserted into the inner wall of the plug cap 14 by inserted. The plug cap 14 is secured to the engine cover EC by the known manner.

According to the above connecting assembly for the ignition plug, since the projection 12*b* of the ignition plug connecting terminal 12 is fixed in the plug cap 14 secured to the engine cover EC, the above mentioned vibration to be transmitted to the ignition plug P connected to the ignition plug connecting terminal 12 can be suppressed thereby reducing the wear of the head of the ignition plug P.

Next, a method for producing the above connecting assembly for the ignition plug will be described by referring to FIG. 2.

Figure 4:
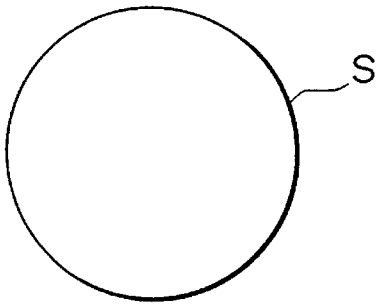
FIG. 4 is a plan view of a terminal body under a step of producing the terminal.
Figure 5:
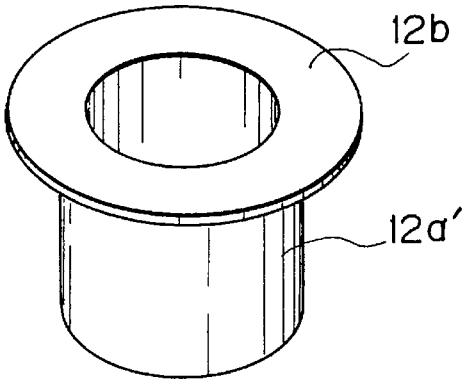
FIG. 5 is a perspective view of a terminal body under a step of producing the terminal.

First, in a step S1, a terminal body 12*a*' and a projection 12*b* shown in FIG. 5 are formed integrally by drawing a stainless disc plate S shown in FIG. 4. However, the terminal body 12*a*' under this state has a bottom part. Another conductive metal plate may be used for the stainless plate S.

Second, in a step S2, the bottom part of the terminal body 12*a*' is removed to form a terminal body 12.

Figure 6:
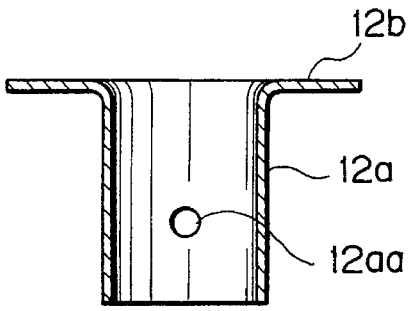
FIG. 6 is a longitudinal sectional view of the terminal body illustrating a through hole.

In a step S3, a through hole 12*aa* is formed in the terminal body 12*a* as shown in FIG. 6. Thus, the terminal 12*a* and projection 12*b* form an ignition plug connecting terminal 12.

Next, in a step S4, a socket body 13*a*' having a bottom part and a projection 13*b* are formed integrally in the same manner as the step S1. The socket body 13*a*' has substantially the same external diameter as that of the terminal body 12*a* of the ignition plug connecting terminal 12 while the projection 13*b* has substantially the same internal diameter as that of the projection 12*b* of the ignition plug connecting terminal 12.

In a step S5, the bottom part of the socket body 13*a*' is also removed to form a socket body 13*a*.

Figure 7:
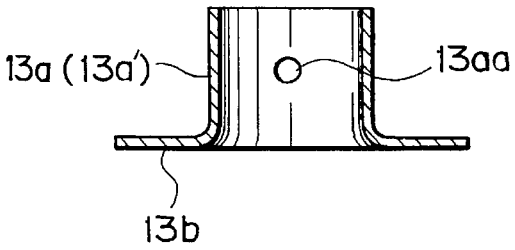
FIG. 7 is a longitudinal sectional view of a socket body illustrating a through hole.

In a step S6, a through hole 13*aa* is formed in the socket body 13*a* (see FIG. 7). In the step S6, the socket body 13*a* and projection 13*b* form a high tension supply terminal socket 13.

In a step S7, the projection 12*b* of the ignition plug connecting terminal 12 is joined to the projection 13*b* of the high tension supply terminal socket 13 by joining means such as spot-welding.

In a step S8, as shown in FIG. 3, the ring 12*c* is mounted on the terminal body 12*a* and the ring 13*c* is mounted on the socket body 13*a* in the same manner. At this time, bosses 12*ca* projecting from the interior of the ring 12*c* mates with the through hole 12*aa* while bosses projecting from the interior of the ring 13*c* mates with the through hole 13*aa*.

Figure 8:
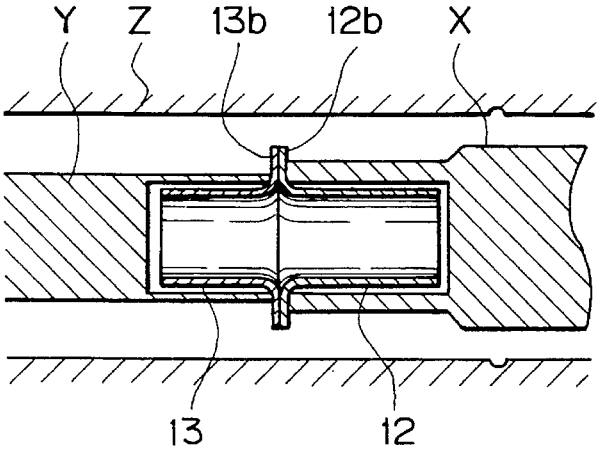
FIG. 8 is a longitudinal sectional view of a plug cap under a producing step.

In a step S9, as shown in FIG. 8, the ignition plug connecting terminal 12 and high tension supply terminal socket 13 joined with each other in the step S7 are fixed by metal molds X and Y and a molten synthetic resin material having heat resisting and insulating properties is poured into a space defined by metal molds X, Y, and Z. Thus, a plug cap 14 which embeds the projections 12*b* and 13*b* in the inner wall is formed.

In a step S10, the high tension supply terminal 11 is press-fitted on an end of the high tension cable C.

In a step S11, the high tension supply terminal 11 together with the high tension cable C are inserted into the plug cap 14 from an end of the cap and the high tension supply terminal 11 is coupled to the high tension supply terminal socket 13 fixed in the plug cap 14. The high tension cable C is fixed in the plug cap 14 with the high tension supply terminal 11 being coupled to the socket 13.

In a step S12, a waterproofing cap 15 is mounted on an end of the plug cap 14 (see FIG. 1).

In a step S13, the plug cap 14 is inserted into a plug bore ECa formed in the engine cover and the ignition plug connecting terminal 12 in the plug cap 14 is coupled to the terminal part Pa of the ignition plug P secured to the engine cover. The plug cap 14 is secured to the engine cover EC at the same time when the ignition plug connecting terminal 12 is coupled to the ignition plug P.

Since the connecting assembly 10 which joins the high tension cable C to the ignition plug P is formed by drawings the ignition plug P is formed by drawing the ignition plug connecting terminal 12, the terminal 12 has no clearance such as a slit or a seam on the outer periphery. Accordingly, the molten resin material does not flow into the ignition plug connecting terminal 12 when the plug cap 14 is formed with the result that a part of the terminal 12 is embedded in the plug cap 14.

Figure 9:
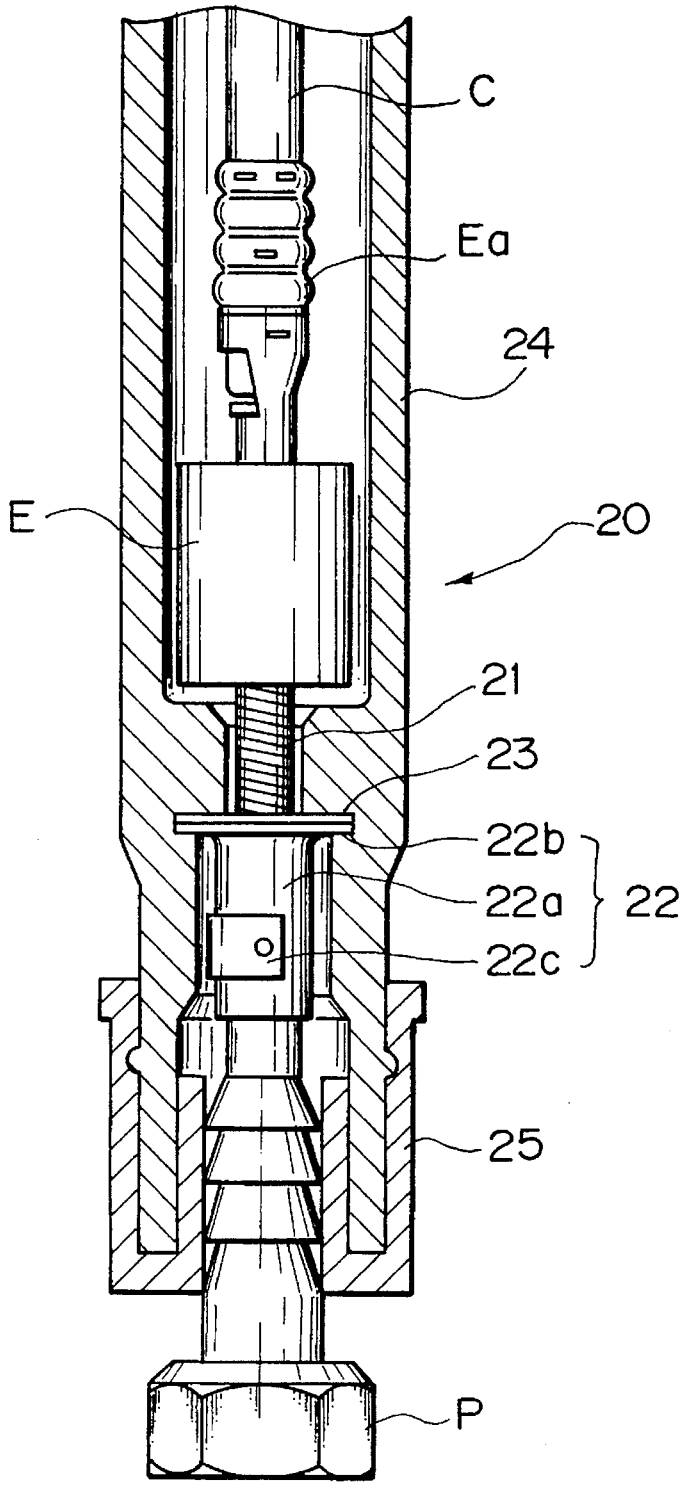
FIG. 9 is a longitudinal sectional view of another embodiment of a connecting assembly for an ignition plug in a gasoline engine in accordance with the present invention.
Figure 10A:
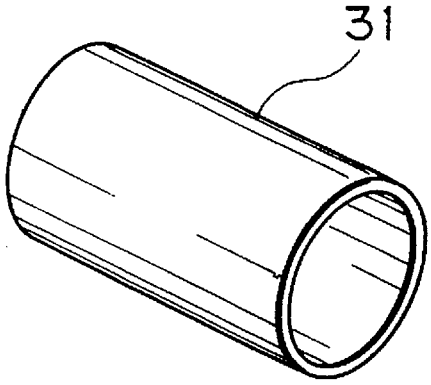
FIGS. 10A and 10B are perspective views of alternations of a terminal body and a socket body under a producing step.
Figure 10B:
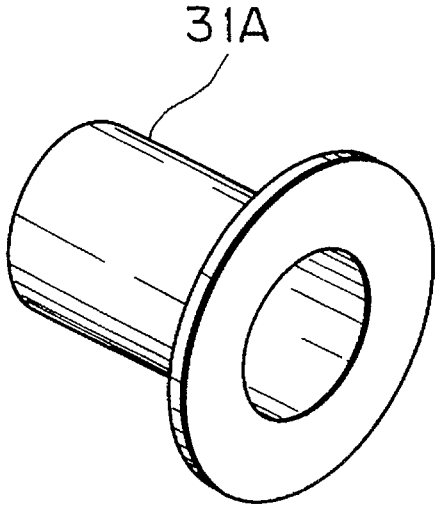

FIG. 9 shows another embodiment 20 of the connecting assembly for the ignition plug in the gasoline engine. In the connecting assembly 20 shown in FIG. 9, the high tension cable C is joined through a discharge tube E to the ignition plug P. An upper electrode of the discharge tube E is connected electrically to the high tension cable C through a terminal Ea. The connecting assembly 20 includes a high tension supply terminal 21, an ignition plug connecting terminal 22, a high tension supply terminal socket 23, and a plug cap 24. The engine cover is omitted in FIG. 9.

The high tension supply terminal 21 is made in a form of a spring which is connected to the other electrode of the discharge tube E.

The ignition plug connecting terminal 22 includes a terminal body 22*a*, a projection 22*b*, and a ring 22*c*. Since the ignition plug connecting terminal 22 is the same as the ignition plug connecting terminal 12 in the former embodiment, detailed explanation thereof is omitted here.

The high tension supply terminal socket 23 is made in a form of a disc-like conductive metal plate such as a stainless disc plate and has the same external diameter as that of the projection 22*b* of the terminal 22.

The plug cap 24 is substantially the same as the plug cap 14 in the former embodiment. The projection 22*b* of the ignition plug connecting terminal and a peripheral part of the high tension supply terminal socket 23 are embedded in the inner wall of the plug cap 24 and the ignition plug connecting terminal 22 and the socket 23 are fixed in the cap 24.

Figure 2:
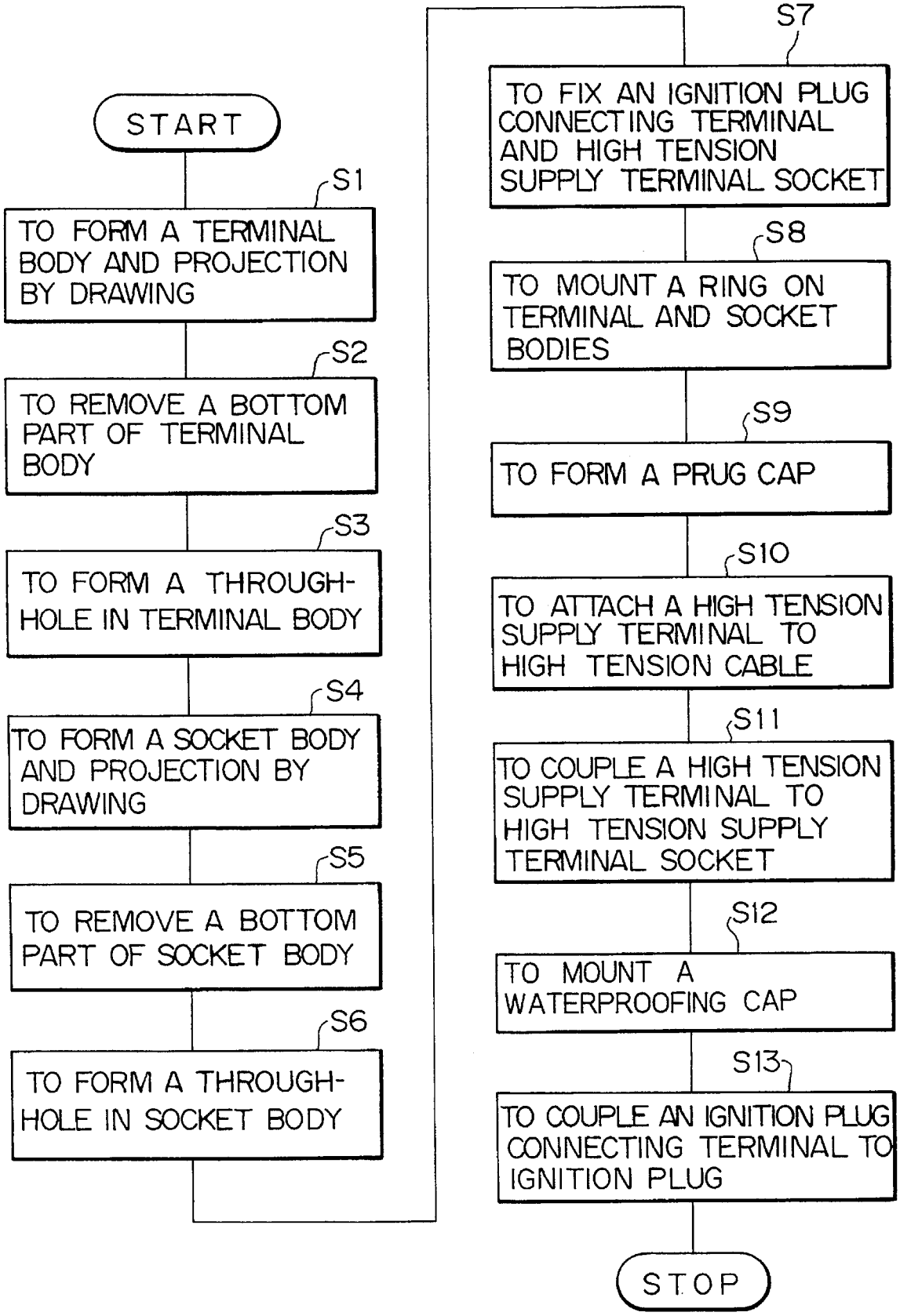
FIG. 2 is a flow chart illustrating an embodiment of a method for producing a connecting assembly for an ignition plug in a gasoline engine in accordance with the present invention.

The above connecting assembly 20 is produced by the substantially same routine as that shown in FIG. 2. However, the steps S4 through S6 are not necessary and the step S8 is not necessary for the high tension supply terminal socket 23. In the step S10 in this embodiment, the high tension supply terminal 21 is connected through a terminal Ea of the discharge tube E to the high tension cable C. The high tension supply terminal 21 contacts the high tension supply terminal socket 23 by pushing the terminal 21 as a spring onto the socket as a plate.

Although the terminal bodies 12*a* and 22*a* and the projections 12*b* and 22*b* of the ignition plug connecting terminals 12 and 22 or the socket bodies 13*a* and the projections 13*b* of the high tension supply terminal socket 13 are formed by drawing the disc-like stainless plate in the first embodiment, a cylindrical body 31A (FIG. 10B) with a flange-like projection which is formed by outwardly extending an end of a cylindrical terminal member 31 (FIG. 10A) may be used for the terminal bodies 12*a* and 22*a* or the socket body 13*a*.

In the connecting assembly for the ignition plug in the gasoline engine shown in FIG. 1 or 9, the terminal body 12*a* and projection 12*b* of the ignition plug connecting terminal 12 or the terminal body 22*a* and projection 22*b* for the ignition plug connecting terminal 22 are formed by drawing the conductive metal plate such as a stainless plate. This makes the ignition plug connecting terminal light and ultimately makes the connecting assembly per se light. Since the conductive metal plate is suitable for drawing of the ignition plug connecting terminal, it is easy to mass-produce the terminals and to reduce wastage of materials in working processes.

However, it is possible in the connecting assembly for the ignition plug in the gasoline engine in accordance with the present invention to substitute a terminal body and a projection of an ignition plug connecting terminal which are formed by turning an aluminium billet, shown in FIGS. 11A and 11B or 12A and 12B, for the terminal body and projection of the terminal shown in FIG. 1 or 9.

Figure 11A:
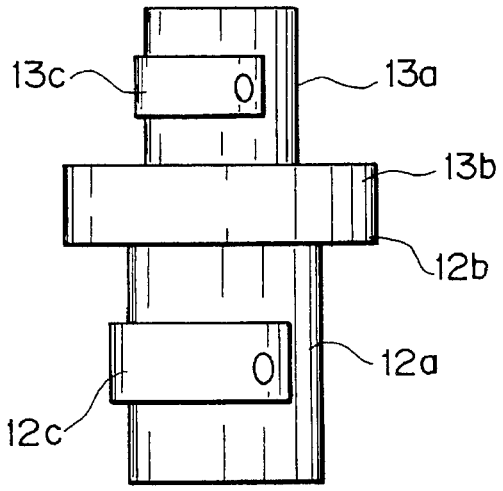
FIGS. 11A and 11B are a side view and a longitudinal sectional view of an alternation of the ignition plug connecting terminal shown in FIG. 1.
Figure 11B:
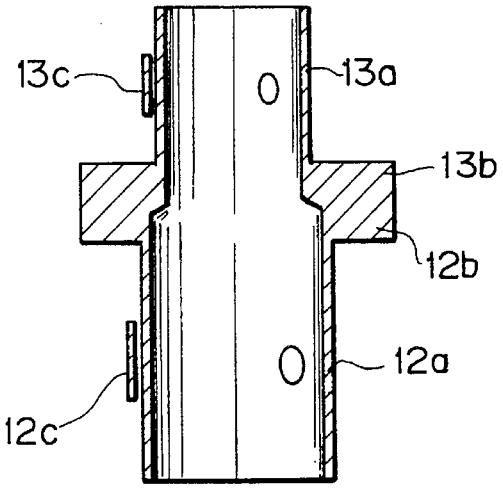

FIG. 11A shows a side view of the ignition plug connecting terminal 12 and high tension supply terminal socket 13 in which the terminal body 12*a*, projection 12*b*, socket body 13*a*, and projection 13*b* are formed integrally by a turning work. FIG. 11B is a longitudinal sectional view of FIG. 11A. In FIGS. 11A and 11B, the projections 12*b* and 13*b* are formed as a single projection.

Figure 12A:
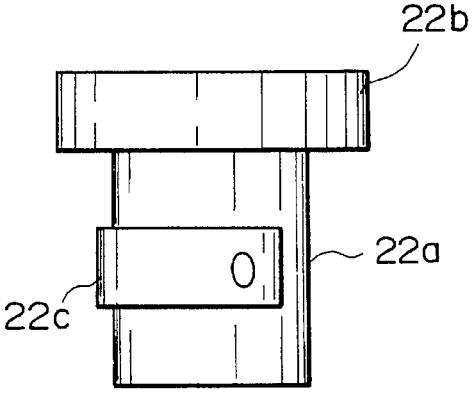
FIGS. 12A and 12B are a side view and a longitudinal sectional view of an alternation of the ignition plug connecting terminal shown in FIG. 9.
Figure 12B:
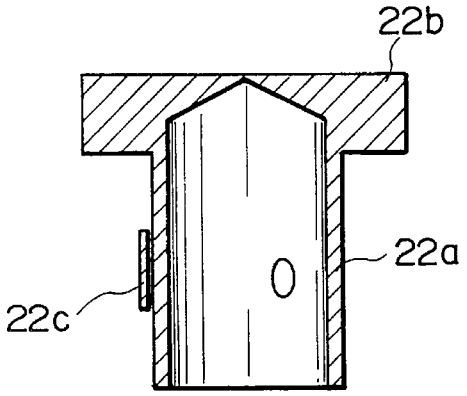
Figure 13:
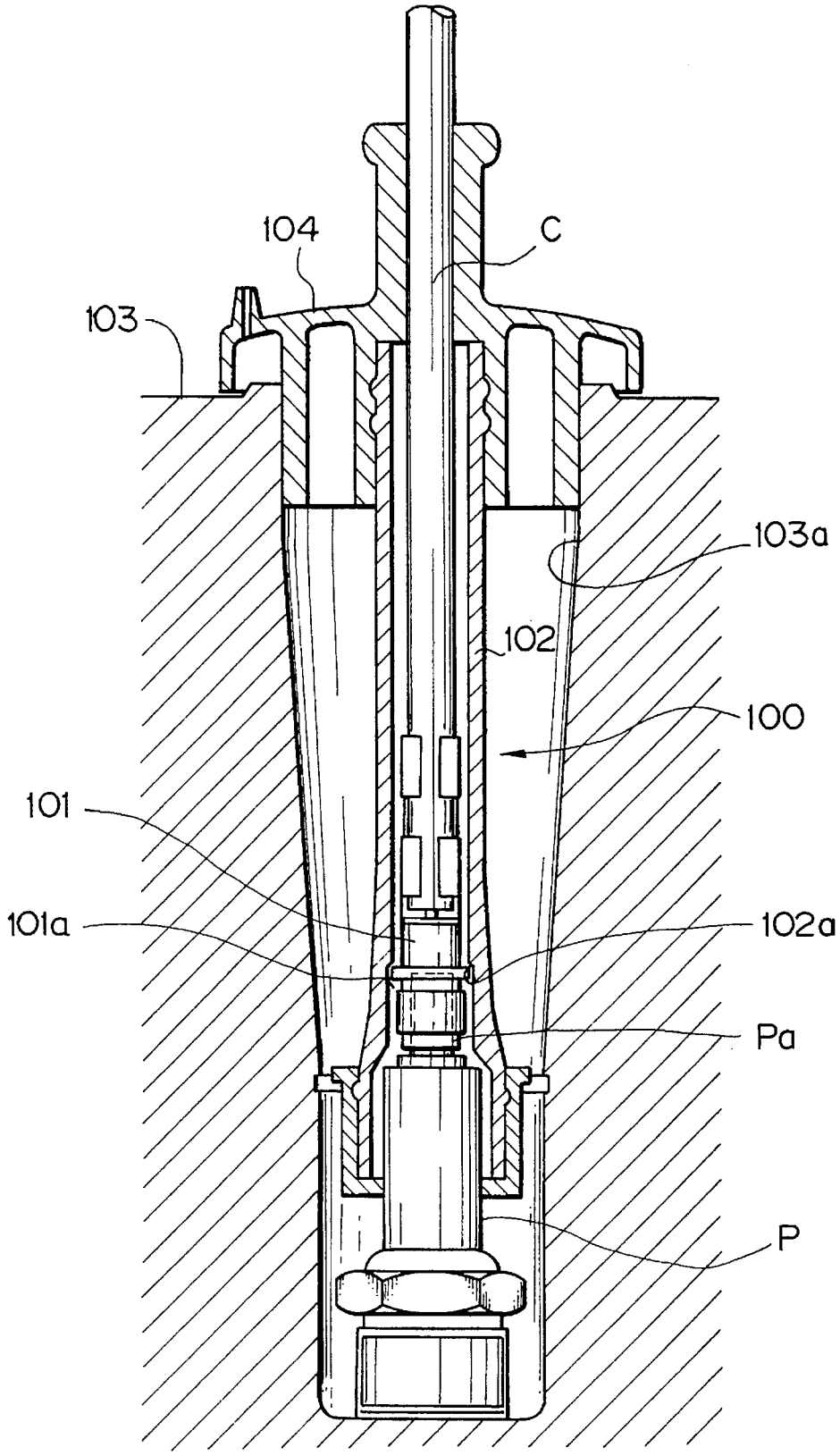
Fig. 13 PRIOR ART
FIG. 13 is a longitudinal sectional view of a conventional connecting assembly for an ignition plug.

On the other hand, FIG. 12A shows a side view of the ignition plug connecting terminal 22 (FIG. 9) in which the terminal body 22*a* and projection 22*b* are formed integrally by the turning work. FIG. 12B is a longitudinal sectional view of FIG. 12A. In FIGS. 11A, 11B, 12A, and 12B, the same signs as those in FIGS. 1 and 9 are given to the respective parts corresponding to FIGS. 1 and 9.

Although the terminal bodies 12*a* and 22*a* or the socket body 13*a* are made in a cylindrical form in the above embodiments, they may be made in a polygonal form.

Also, another electrical element except for the discharge tube may be disposed between the high tension supply terminal and the high tension cable.

According to the present invention, it is possible to reduce wear of the head of the ignition plug, since the movement of the ignition plug connecting terminal with respect to the ignition plug is limited by an integral construction of the terminal and the plug cap.

In addition, since the ignition plug connecting terminal is formed by the drawing work, the terminal has no clearance such as a slit or a seam on the outer periphery, thereby preventing the molten resin material from flowing into the terminal when the plug cap is formed so that the projection of the terminal is embedded in the plug cap. Accordingly, it is possible to eliminate a problem that the ignition plug connecting terminal can not be coupled to the ignition plug on account of the resin material flown into the terminal.

What is claimed is:

1. A connecting assembly for an ignition plug for a gasoline engine wherein a high tension cable is connected to said ignition plug, said assembly comprising:

a high tension supply terminal electrically connected to said cable;

an ignition plug connecting terminal having a terminal flange at one end and a pair of through holes at another end, said terminal being formed by deep-drawing a sheet of thin metal plate and adapted to receive a distal end of said ignition plug at said other end;

a high tension supply terminal socket between said connecting terminal and said supply terminal, said socket having a socket flange at one end and a pair of through holes at another end, said socket being formed by deep-drawing a sheet of thin metal plate and adapted to receive a distal end of said supply terminal, said terminal flange and said socket flange being in electrical contact with each other;

a retainer ring at least partially encircling each of said connecting terminal and socket and having two retaining protuberances on an inner surface thereof, two through holes in each of said connecting terminal and socket complementary to said retaining protuberances, whereby said retaining protuberances project radially inwardly of said inner surface so that, when said distal ends of said plug and terminal are introduced into said connecting terminal and socket respectively, said rings are urged resiliently and radially outwardly, thereby retaining said distal ends in said connector terminal and socket; and a substantially cylindrical, non-conducting plug cap adapted to receive said connecting terminal and socket with said flanges embedded therein.

2. The assembly of claim 1 wherein said plug cap comprises recesses complementary to said terminal flange and said socket flange.

* * * * *